US006102980A

United States Patent [19]

Endo et al.

[11] Patent Number: 6,102,980

[45] Date of Patent: Aug. 15, 2000

[54] DUST CORE, FERROMAGNETIC POWDER COMPOSITION THEREFOR, AND METHOD OF MAKING

[75] Inventors: Masami Endo; Takeo Tsukada; Masaaki Kanasugi; Kazuhiro Okada; Hideharu Moro; Norishige Yamaguchi, all of Chiba; Toshiaki Yamada, Saitama; Hideki Kitashima, Gunma, all of Japan

[73] Assignee: TDK Corporation, Tokyo, Japan

[21] Appl. No.: 09/048,160

[22] Filed: Mar. 26, 1998

[30] Foreign Application Priority Data

Mar. 31, 1997 [JP] Japan ..... 9-096731
Dec. 27, 1997 [JP] Japan ..... 9-368032

[51] Int. Cl.[7] ..... B22F 1/00

[52] U.S. Cl. ..... 75/252; 148/102; 148/104; 148/306; 252/62.53; 252/62.54; 252/62.55

[58] Field of Search ..... 148/102, 104, 148/306; 252/62.53, 62.54, 62.55; 75/252

[56] References Cited

U.S. PATENT DOCUMENTS 5,039,559 8/1991 Sang et al. ..... 427/213.3
5,651,841 7/1997 Moro et al. ..... 148/309
5,702,630 12/1997 Sasaki et al. ..... 252/62.52
5,800,636 9/1998 Tsukada et al. ..... 148/306
5,880,201 3/1999 Enomoto et al. ..... 524/492

FOREIGN PATENT DOCUMENTS 0 088 992 9/1983 European Pat. Off. .
0 225 392 6/1987 European Pat. Off. .

OTHER PUBLICATIONS

Patent Abstracts of Japan, vol. 011, No. 152 (E–507), May 16, 1987, JP 61–288403, Dec. 18, 1986.

Patent Abstracts of Japan, vol. 016, No. 494 (M–1324), Oct. 13, 1992, JP 04–180502, Jun. 26, 1992.

*Primary Examiner*—Ngoclan Mai
*Attorney, Agent, or Firm*—Oblon, Spivak, McClelland, Maier & Neustadt, P.C.

[57] ABSTRACT

A ferromagnetic powder composition for dust cores contains a ferromagnetic metal powder and 0.1–15% by volume based on the powder of titania sol and/or zirconia sol. The composition is pressure molded and desirably annealed into a dust core which exhibits a high magnetic flux density, low coercivity, low loss and high mechanical strength.

13 Claims, 1 Drawing Sheet

DUST CORE, FERROMAGNETIC POWDER COMPOSITION THEREFOR, AND METHOD OF MAKING

BACKGROUND OF THE INVENTION

1. Field of the Invention

This invention relates to dust cores for use as magnetic cores in transformers and inductors, cores in motors, and other electromagnetic parts, ferromagnetic powder compositions for forming the dust cores, and a method for preparing the dust cores.

2. Prior Art

In the prior art, silicon steel lamination cores having punched silicon steel sheets stacked are often used in inductance elements of electronic devices. The lamination cores, however, are difficult to automate a manufacturing process. Especially when cores for motors and other drive equipment are prepared by punching from sheets, the material yield is extremely low because such cores have a complex shape. To fabricate three-dimensional shapes, a great number of working steps is necessary.

There are known dust cores or powdered-iron cores wherein ferromagnetic metal powder is bound with a binder such as water glass. Iron powder, permalloy powder and sendust powder are typical of the ferromagnetic metal powder. Dust cores can be integrally formed and worked even if they are of complex shape. The material yield is substantially 100%. The dust cores are expected to become a substitute for the lamination cores.

The ferromagnetic alloy powders such as permalloy powder and sendust powder, however, cannot be a substitute for the silicon steel lamination core commonly used in drive equipment because these powders have a low magnetic flux density despite a low coercivity.

With respect to iron powder, there are commercially available different forms of iron powder prepared by various processes such as electrolytic decomposition and water atomization processes. They have a coercivity of more than 2 Oe which is not so low as comparable to silicon steel. Gas atomized iron powder has a coercivity of about 1 Oe, but is extremely expensive and thus inadequate as a substitute for the silicon steel lamination core.

A number of proposals have been made for improving the characteristics of dust cores.

For example, Japanese Patent Application Kokai (JP-A) 72102/1987 discloses an iron powder for dust cores having an oxygen content of 0.15 to 0.5% by weight, a mean particle size of 40 to 170 $\mu$m and an average aspect ratio of 4/1 to 25/1. Oxide coatings on iron particles provide for insulation between particles to reduce eddy current losses. The oxygen content is relatively high because the target is a high frequency band of higher than about 1 MHz. Since dust cores are prepared using an epoxy resin binder, annealing treatment at high temperature for reducing coercivity is precluded, resulting in dust cores having increased hysteresis losses.

JP-A 824027/1986 discloses in Examples iron cores which are prepared by mixing an iron powder having a mean particle size of 54 $\mu$m with a titania powder having a mean particle size of 0.3 $\mu$m or a zirconia powder having a mean particle size of 1 $\mu$m and pressure molding the mixture. JP-A 260005/1988 discloses a magnetic core which is prepared by adding silicon oxide having a particle diameter of up to 1 $\mu$m to an iron powder of −200 mesh. These dust cores, however, have several problems including (1) substantial core losses, (2) low magnetic flux densities because large amounts of insulating material are needed for insulation, (3) difficult lowering of coercivity because they cannot be annealed at high temperature and the strain created during molding is not fully relaxed.

To comply with the recent trend toward the size reduction of electric and electronic equipment, dust cores are required to be compact and efficient. Cores of ferromagnetic metal powder can be reduced in size owing to the high saturated magnetic flux density of the powder, but substantial eddy current losses occur because of the low electric resistance. Then ferromagnetic metal particles are often covered on the surface with insulating coatings. In the dust core manufacturing process, annealing is usually effected in order to release the strain or stress created during molding and to reduce the coercivity of dust cores. Annealing must be done at high temperature in order to fully relieve ferromagnetic metal particles from stresses. However, since water glass or a similar insulating material experiences a substantial loss at high temperature, high temperature annealing results in insufficient insulation among ferromagnetic metal particles. This, in turn, results in substantial eddy current losses in the high frequency region, exacerbates the frequency response of magnetic permeability, and increases the core loss. No satisfactory magnetic properties are obtained.

SUMMARY OF THE INVENTION

Therefore, an object of the present invention is to provide a dust core which can be annealed at high temperature and has a high magnetic flux density, low coercivity, low loss and high mechanical strength. Another object of the present invention is to provide a ferromagnetic powder composition for use in the preparation of the dust core. A further object of the present invention is to provide a method for preparing the dust core.

In a first aspect, the invention provides a ferromagnetic powder composition for dust cores comprising a ferromagnetic metal powder and a titania sol and/or a zirconia sol. The titania sol and/or a zirconia sol is present in an amount of 0.1 to 15% by volume based on the ferromagnetic metal powder. Preferably, the titania and/or zirconia sol has a mean particle size of 0.01 to 0.1 $\mu$m. the ferromagnetic metal powder is preferably of iron.

The ferromagnetic powder composition may further contain 0.1 to 30% by volume based on the ferromagnetic metal powder of a heat resistant resin. In one embodiment, the heat resistant resin is a silicone resin, preferably having a weight average molecular weight of 700 to 3,300. In another embodiment, the heat resistant resin is an epoxy resin, phenoxy resin, polyamide resin, polyimide resin or polyphenylene sulfide resin. In a further embodiment, the heat resistant resin is a phenolic resin, preferably a resol type phenolic resin. The phenolic resin preferably has a weight average molecular weight of 300 to 7,000.

In a second aspect, the invention provides a dust core which has been prepared by pressure molding a ferromagnetic powder composition as defined above and optionally, heat treating the resulting compact and then impregnating the compact with a resin.

In a third aspect, the invention provides a method for preparing a dust core by pressure molding a ferromagnetic powder composition as defined above into a compact and heat treating the compact. The treating temperature is 400 to 700° C. when the composition is free of a heat resistant resin or contains a silicone resin, epoxy resin, phenoxy resin, polyamide resin, polyimide resin or polyphenylene sulfide resin as the heat resistant resin. The heat treating temperature is 500 to 850° C. when the composition contains a phenolic resin.

ADVANTAGES

The ferromagnetic powder composition for dust cores according to the invention is based on a ferromagnetic metal powder. A titania sol and/or zirconia sol is added in an amount of 0.1 to 15% by volume based on the ferromagnetic metal powder. Titania and zirconia are titanium oxide and zirconium oxide, which are typically represented by $TiO_2$ and $ZrO_2$, respectively. By adding titania sol or zirconia sol in the form of microparticulates uniformly dispersed in a medium to the ferromagnetic metal powder, the particles are covered with a thin uniform insulating coating so that the coated particles have high insulation as well as a high magnetic flux density. The high insulation is effective for reducing the eddy current loss and hence, the overall loss or core loss.

In the embodiment wherein a heat resistant resin such as a silicone resin or phenolic resin is added, the resin assists titania or zirconia particulates in the sol in attaching to the surfaces of ferromagnetic metal particles so that the metal particle surface may be uniformly covered with the titania or zirconia particulates. The resin is also effective for improving strength. Dust cores having the phenolic resin added can be annealed at a high temperature of 500 to 850° C. in order to improve magnetic properties, without deteriorating insulation. By the high temperature annealing, the strain or stress induced in the powder during pulverization and molding is released so that the dust cores are reduced in coercivity and hence, hysteresis loss. Since the insulation is retained, the dust cores undergo reduced eddy current losses and hence, reduced overall or core losses.

There are known several dust cores using a phenolic resin as the insulator like the present invention.

JP-A 130103/1980 discloses a method for preparing a magnetic material compact by coating metal magnetic power particles on their surface with an inorganic insulating layer, applying an organic insulating layer thereon, and pressure molding the powder. In Examples, pure iron powder is used as the metal magnetic powder, water glass is used as the inorganic insulating layer, and a phenolic resin is used as the organic insulating layer. Since molding is not followed by annealing, the compact has a high coercivity due to the stress left after molding.

JP-A 155510/1981 discloses a powdered-metal core prepared by adding at least one of water glass and an organic resin insulating agent and 0.2 to 2.0% of zinc stearate to a metal magnetic powder and thermocompression molding the mixture. In Examples, metal dust cores are prepared by adding water glass and a phenolic resin to pure iron powder, adding zinc stearate to the mixture, molding the mixture under a pressure of 7 ton/cm$^2$, and heat treating the molded part at 150° C. for 30 minutes. With heating temperatures of this level, the stress created during molding is left unrelieved and the coercivity remains high.

JP-A 288403/1986 discloses a dust core prepared by adding 1 to 5% by volume of a phenolic resin to atomized pure iron powder of under 60 mesh, followed by compression molding and curing treatment. In Examples, dust cores are prepared by adding a phenolic resin to pure iron powder, adding zinc stearate lubricant thereto, molding the mixture under a pressure of 5 ton/cm$^2$, and heating the molded part at 80° C. for 2 hours and then at 180°C. for 2 hours for curing. With heating temperatures of this level, the stress created during molding is left unrelieved and the coercivity remains high.

JP-A 225303/1989 discloses a method for preparing a dust core by binding ferromagnetic particles with a binder resin in the form of a thermosetting resin, pressure molding the powder in a mold into a compact, and heat curing the compact in the mold while the compact is kept compressed. In Examples, an epoxy resin is used as the binder. Since the resin is not combined with an inorganic substance, a low eddy current loss and a low core loss as achieved in the present invention are not obtainable.

BRIEF DESCRIPTION OF THE DRAWINGS

The only figure.

DESCRIPTION OF THE PREFERRED EMBODIMENTS

Figure 1:
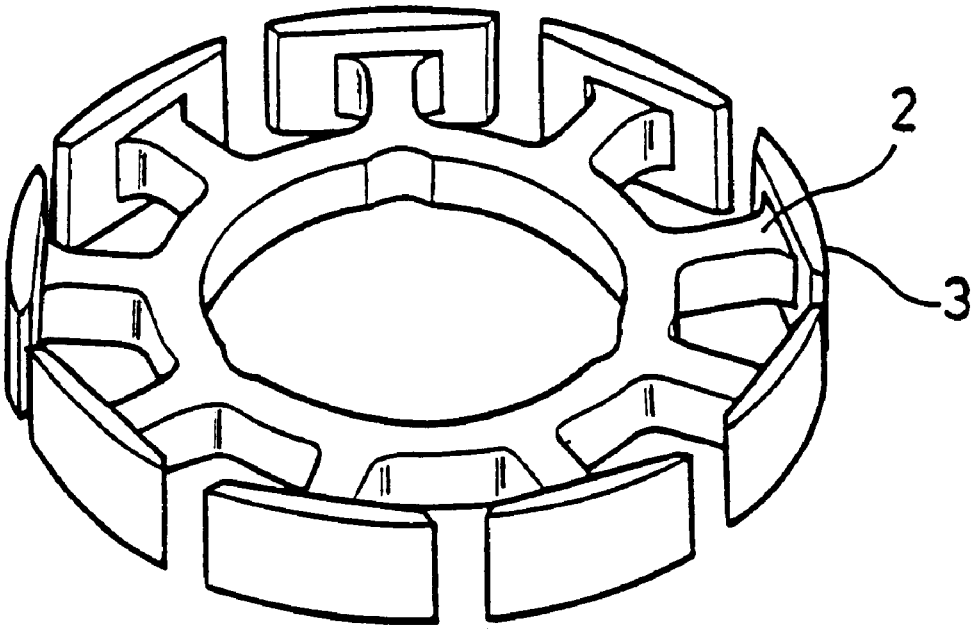
FIG. 1 is a schematic perspective view of an exemplary motor stator core.

According to the invention, a ferromagnetic powder composition for used in the preparation of dust cores is obtained by adding a titania sol or a zirconia sol or both to a ferromagnetic metal powder. The titania sol or zirconia sol is added in an amount of 0.1 to 15% by volume, calculated as $TiO_2$ or $ZrO_2$, based on the ferromagnetic metal powder.

By adding titania sol or zirconia sol in the form of microparticulates uniformly dispersed in a medium to the ferromagnetic metal powder, the particles are covered with a thin uniform insulating coating even though the titania or zirconia sol is used in a small amount. The coated particles are fully insulated while they have a high magnetic flux density.

By the term titania or zirconia sol, it is meant that negatively charged amorphous titania or zirconia particulates are dispersed in water or an organic dispersing medium in a colloidal state, with —TiOH or —ZrOH groups being present on the surfaces of the particulates. In the sol, titania or zirconia particulates preferably have a mean particle size of 0.01 to 0.1 $\mu$m, more preferably 0.01 to 0.08 $\mu$m, especially 0.02 to 0.06 $\mu$m. The content of particulates is about 15 to about 40% by weight of the sol.

An optimum amount calculated as solids of the titania or zirconia sol added to the ferromagnetic metal powder, that is, an optimum amount of titania or zirconia particulates added to the ferromagnetic metal powder varies with the frequency at which the dust core is used. For operation at 0.1 to 10 kHz, an optimum amount of titania or zirconia sol calculated as solids is 0.1 to 10% by volume, more desirably 0.1 to 5.0% by volume, most desirably 0.1 to 2.0% by volume. For operation at frequencies higher than 10 kHz, an optimum amount of titania or zirconia sol calculated as solids is 0.1 to 15% by volume, more desirably 0.2 to 15% by volume, most desirably 0.5 to 5.0% by volume, because more effective insulation between metal particles is required. If the amount of titania or zirconia sol calculated as solids is too small, the insulation between ferromagnetic metal particles in the dust core becomes insufficient. If the amount of titania or zirconia sol calculated as solids is too large, the dust core contains a more proportion of a non-magnetic component such as $TiO_2$ or $ZrO_2$ and shows a lower magnetic permeability and magnetic flux density.

The titania or zirconia sol may be used alone or in admixture of these two. In the latter case, the ratio of titania sol to zirconia sol is not critical although the amount of titania and zirconia sols combined should fall in the above-defined range.

The titania sol and zirconia sol are commercially available, for example, in the trade name of NZS-20A, NZS-30A and NZS-30B from Nissan Chemical Industry K.K. If such sol is at a low pH level, it is preferably adjusted to about pH 7. Low pH sol has the risk that the ferromagnetic metal powder can be oxidized into non-magnetic oxide to detract from a magnetic flux density and coercivity.

The media for these sols may be either aqueous or non-aqueous. Media compatible with the heat resistant resin to be described later are preferable, and non-aqueous media such as ethanol, butanol, toluene and xylene are especially preferable. For a commercially available sol based on an aqueous medium system, solvent exchange is carried out if desired. The sol may further contain chloride ion or ammonia as a stabilizer. These sols are generally milky white colloidal solutions.

The ferromagnetic metal powder is not critical and a choice may be made among well-known magnetic material powders, for example, iron, Sendust (Fe—Al—Si), ferrosilicon, permalloy (Fe—Ni), supermalloy (Fe—Ni—Mo), iron nitride, iron-aluminum alloys, iron-cobalt alloys, and ferrophosphorous. Of these, iron powder having high saturation magnetization is preferred when it is desired to prepare dust cores as a substitute for the currently available cores prepared from laminated silicon steel sheets adapted for operation in a relatively low frequency region. Iron powder may be prepared by any of an atomizing method, an electrolytic decomposition method, and a method of mechanically comminuting electrolytic iron.

When an alloy is used as the ferromagnetic metal powder, annealing at a higher temperature becomes necessary because alloy particles are harder than iron particles so that a greater stress is induced during molding. Therefore, the advantage of the invention that the dust core-forming ferromagnetic powder composition comprising a ferromagnetic metal powder, a titania sol and/or zirconia sol, and a phenolic resin maintains insulation even at higher annealing temperatures becomes outstanding when alloy powder is used.

When iron powder is used, its mean particle size should preferably fall in the range of 50 to 200 $\mu$m, especially 75 to 100 $\mu$m. An iron powder with a too smaller mean particle size would have a greater coercivity whereas an iron powder with a too larger mean particle size would have a greater eddy current loss. The iron powder having a particle size in the above range may be collected by classification using a screen. It is preferred that the other ferromagnetic metal powders have a similar particle size.

If desired, the ferromagnetic metal powder may be flattened. For toroidal and E shaped cores having parallelepiped legs, for example, it is possible to mold the composition while applying pressure in a direction perpendicular to the magnetic path direction during operation, that is, transverse pressure molding. Since the transverse pressure molding makes it easy to mold a dust core such that the major surfaces of flat particles may be substantially parallel to the magnetic path, the magnetic permeability of the dust core is readily improved using flat particles. Flattening may be done by any desired means, preferably mills having rolling or shearing action, such as ball mills, rod mills, vibration mills, and attrition mills. The degree of flattening is not critical although flat particles having an average aspect ratio of from about 5/1 to about 25/1 are usually preferred. The aspect ratio is an average of a minor diameter and a major diameter on the major surface divided by the thickness of a particle.

In one preferred embodiment, a heat resistant resin is added to the ferromagnetic metal powder as well as the sol. The heat resistant resin assists titania or zirconia particulates in the sol in attaching to the surfaces of ferromagnetic metal particles so that the metal particle surface may be uniformly covered with the titania or zirconia particulates. The resin is also effective for improving strength. If the surfaces of ferromagnetic metal particles are covered too much uniformly, the ferromagnetic metal particles can be restrained from sliding motion therebetween, which prevents the compact from being consolidated to the desired density by pressure molding, with the resultant loss of strength. Depending on the type and size of particulates in the sol as well as the type and size of the ferromagnetic metal powder, an appropriate resin is selected. The heat resistant resin used is not critical although it is preferably selected from silicone resins, phenolic resins, epoxy resins, phenoxy resins, polyamide resins, polyimide resins, and polyphenylene sulfide (PPS) resins. Those resins having a pyrolysis temperature of at least 600° C. are preferable. The amount of the heat resistant resin added is preferably 0.1 to 10% by volume, more preferably 0.1 to 1.0% by volume based on the ferromagnetic metal powder when the dust core is to be operated at a frequency of 0.1 to 10 kHz. The amount of the heat resistant resin added is preferably 1 to 30% by volume, more preferably 2 to 20% by volume based on the ferromagnetic metal powder when the dust core is to be operated at a frequency in excess of 10 kHz. A too less amount of the heat resistant resin would be ineffective for improving the mechanical strength of the core whereas a too much amount of the heat resistant resin would increase the proportion of non-magnetic component in the core which thus has a lower magnetic flux density.

The silicone resin should preferably have a weight average molecular weight of about 700 to about 3,300.

Addition of the phenolic resin is effective for increasing the strength of a compact, which becomes easy to handle after molding. Even when the annealing temperature is raised to about 850° C., the insulation by the resin is unlikely to deteriorate, resulting in a low eddy current loss and a lower core loss.

After pressure molding, the resulting compacts are preferably annealed for the purpose of improving the magnetic properties thereof. High temperature annealing can invite a greater loss of the resin, resulting in insufficient insulation between ferromagnetic metal particles. However, when the titania sol and/or zirconia sol and the phenolic resin are used as the insulator, the insulation is not readily deteriorated even by high temperature annealing. The strain or stress induced during powdering or molding is more effectively relieved so that the dust core is reduced in coercivity and hence, hysteresis loss. The retained insulation ensures a low eddy current loss and hence, a low overall loss or core loss.

If the phenol resin is the sole insulator, annealing temperatures as high as 600° C. can deteriorate insulation, resulting in a greater eddy current loss and hence, a greater core loss.

The phenolic resins used herein are generally formed from phenols and aldehydes. Various phenols such as phenol, cresols, xylenols, bisphenol A, and resorcinol may be used alone or in admixture. Various aldehydes such as formaldehyde, para-formaldehyde, acetaldehyde and benzaldehyde may be used alone or in admixture.

The phenolic resins include resol and novolak type resins. As the catalyst used in reacting phenols with aldehydes to form resins, the resol type resins use basic substances and the novolak type resins use acidic substances. The resol type resins are cured into insoluble infusible form by heating or with acid catalysts. The novolak type resins are soluble fusible resins which do not thermoset by themselves, and they are cured by heating in the co-presence of hexamethylenetetramine and other crosslinking agents.

In the practice of the invention, resol type phenolic resins are preferred. When novolak type phenolic resins are used, molded parts are rather weak and thus difficult to handle in the subsequent steps. When novolak type phenolic resins are used, heat molding, typically hot pressing, is essential. The temperature of heat molding is usually about 150 to 400° C. although it varies with a particular resin. Among phenolic resins, resol type phenolic resins containing nitrogen in the form of tertiary amine are especially preferred because of high heat resistance. Among the novolak type phenolic resins, those containing hexamine are preferred.

The phenolic resins should preferably have a weight average molecular weight of about 300 to about 7,000, more preferably about 500 to about 7,000, most preferably about 500 to about 6,000. A phenolic resin with a relatively low molecular weight tends to provide a molded part with a higher strength, minimizing powdering of the molded part at edges. However, a resin with a molecular weight of less than 300 can be lost more upon high temperature annealing, failing to maintain insulation between ferromagnetic metal particles in the dust core, and resulting in a greater eddy current loss and hence, a greater core loss.

The phenolic resins are commercially available, for example, in the trade name of BRS-3801, ELS-572, 577, 579, 580, 582 and 583 (all of the resol type) and BRP-5417 (of the novolak type) from Showa Polymer K.K.

The amount of the phenolic resin added is preferably 0.1 to 10% by volume, more preferably 0.1 to 1.0% by volume based on the ferromagnetic metal powder when the dust core is to be operated at a frequency of 0.1 to 10 kHz. The amount of the phenolic resin added is preferably 1 to 30% by volume, more preferably 2 to 20% by volume based on the ferromagnetic metal powder when the dust core is to be operated at a frequency in excess of 10 kHz. A too less amount of the phenolic resin would lead to cores having a low mechanical strength and defective insulation whereas a too much amount of the phenolic resin would increase the proportion of non-magnetic component in the core which thus has a lower magnetic flux density.

The heat resistant resins may be added alone or in admixture of two or more. Where two or more resins are added, their total amount should preferably fall in the above-defined range.

In mixing the heat resistant resin with the ferromagnetic metal powder, the heat resistant resin may take the form of a solution prior to mixing if it is solid or liquid or be directly mixed with the metal powder if it is liquid. The liquid heat resistant resin should preferably have a viscosity of about 10 to 10,000 centipoise at 25° C., more preferably about 1,000 to 9,000 centipoise at 25° C. In the case of phenolic resins, liquid resins should preferably have a viscosity of about 10 to 5,000 centipoise at 25° C., more preferably about 50 to 2,000 centipoise at 25° C. With a viscosity outside this range, it would be difficult to form a uniform coating of the resin around ferromagnetic metal particles.

Next, the method of preparing dust cores according to the invention is described.

First of all, the ferromagnetic metal powder is mixed with the titania sol and/or zirconia sol and optionally a heat resistant resin.

Where iron powder is used as the ferromagnetic metal powder, the iron powder is preferably subject to heat treatment for stress-relief annealing prior to mixing. It is preferred to fully reduce the coercivity of iron powder by carrying out heat treatment at high temperatures. Also prior to mixing, the iron powder may be subject to oxidizing treatment. This oxidizing treatment forms an oxide coating as thin as several tens of nanometers near the surface of iron particles whereupon an improvement in insulation is expectable. The oxidizing treatment may be done by heating in an oxidizing atmosphere such as air at a temperature of 150 to 300° C. for 5 minutes to 2 hours. It is noted that where oxidizing treatment is done, a dispersant such as ethyl cellulose may be further added in order to improve the wettability of the iron particle surface.

When the ferromagnetic metal powder is mixed with titania sol and/or zirconia sol and optionally a heat resistant resin, the sol is added in the form of a colloidal solution as previously defined. Mixing is carried out in a pressure kneader or automated mortar, preferably at about room temperature for about 10 to 60 minutes. The resulting mixture is dried preferably at a temperature of about 100 to 300° C. for about 10 to 60 minutes, yielding a ferromagnetic powder composition for dust cores.

After drying and prior to molding, a lubricant is preferably added to the core-forming ferromagnetic powder composition. The lubricant serves to enhance lubrication among particles during compaction and improve release of a compact from a mold. The lubricant may be selected from various lubricants commonly used in dust cores, including organic lubricants which are solid at room temperature, for example, higher fatty acids and salts thereof such as stearic acid, zinc stearate, and aluminum stearate and wax; and inorganic lubricants such as molybdenum disulfide. The amount of lubricant added varies with a particular type of lubricant. Preferably a normally solid organic lubricant is added to the ferromagnetic powder in an amount of 0.1 to 1% by weight, and an inorganic lubricant is added to the ferromagnetic powder in an amount of 0.1 to 0.5% by weight. A less amount of the lubricant would be ineffective whereas a larger amount of the lubricant would result in a core having lower magnetic permeability and strength.

Next, the core-forming ferromagnetic powder composition is molded into a compact of the desired core shape. The core shape to which the invention is applicable is not critical and includes toroidal, E, I, F, C, EE, EI, ER, EPC, jar, drum, pot and cup shapes, for example. Since the dust core of the invention is prepared by compaction, it can take any complex shape. One exemplary core shape is shown in FIG. 1. The core shown in FIG. 1 is a stator core for use in a brushless motor for hard disc drives. The stator core is slotted to define radial posts 2 having a coil wound thereon wherein a magnetic flux leaking from magnetic poles 3 at the tip of the posts 2 is utilized. The stator core of this configuration has an increased copper loss through the winding as compared with a core used in a closed magnetic circuit such as a toroidal core. Nevertheless, the invention reduces the overall loss of the circuit since the dust core of the invention has a reduced core loss. The stator core of the illustrated configuration wherein the height dimension of the post 2 is smaller than the height dimension of the magnetic pole 3 enables utilization of more magnetic flux and miniaturization. The size of the stator core may be properly determined depending on a particular object to which it is applied. Typically, the stator core has an inner diameter of about 3 to 20 mm and about seven (7) to forty (40) slots with a radial length of about 5 to 15 mm.

Compacting conditions are not critical and may be properly determined depending on the type, shape and size of iron powder (ferromagnetic metal powder) particles as well as the size and density of an end core. Typically, the maximum pressure is about 6 to 20 ton/cm$^2$ and the holding time at the maximum pressure is about 0.1 second to 1 minute.

After the compaction, the compact is preferably heat treated or annealed for improving magnetic properties as a core. The annealing treatment serves to relieve stresses which have been introduced into iron (ferromagnetic metal) particles during pulverization and compaction. Where ferromagnetic metal particles have been mechanically flattened, the stresses introduced thereby can also be relieved by the annealing treatment. The annealing treatment also causes the heat resistant resin to fully cure and the compact to increase its density for improving mechanical strength.

Conditions of the annealing treatment may be properly determined depending on the type of ferromagnetic metal powder, compacting conditions, and flattening conditions. For phenolic resin-free dust cores, the typical annealing temperature is about 400 to 700° C., preferably about 550 to 650° C. For phenolic resin-laden dust cores, the typical annealing temperature is about 500 to 850° C., preferably about 600 to 750° C. The dust cores of the invention can be annealed at higher temperatures than conventional annealing temperatures (of about 200 to 500° C.), ensuring that stresses are so effectively relieved that the dust cores are reduced in coercivity and hence, hysteresis loss. Lower annealing temperatures would invite insufficient restoration of coercivity, an increased hysteresis loss and hence, an increased core loss. Too higher annealing temperatures would cause the insulating coating to be thermally broken, resulting in insufficient insulation and increased eddy current losses. The annealing time, that is, the time of passage through the above-defined temperature range or the time when the compact is maintained in the above-defined temperature range is preferably about 10 minutes to about 3 hours. A shorter time achieves insufficient annealing effect whereas a longer time tends to break insulation.

For preventing the magnetic flux density from declining due to oxidation of ferromagnetic metal particles, the annealing treatment is carried out in a non-oxidizing atmosphere such as nitrogen, argon or hydrogen.

If desired, the core as annealed (or heat treated) is impregnated with a resin or the like. The resin impregnation further increases strength. The resins used for impregnation are typically phenolic resins, epoxy resins, silicone resins and acrylic resins, with the phenolic resins being especially preferred. The resins may be dissolved in suitable solvents such as ethanol, acetone, toluene and pyrrolidone.

The core is impregnated with the resin, for example, by placing the core in a container such as a vat, pouring a solution of the resin in a solvent (e.g., a 10% ethanol solution of a phenolic resin) into the container until the core is entirely immersed in the solution, keeping the core immersed for about 1 to 30 minutes, taking the core out of the solution, removing the resin solution carried on the core, and heat treating the core. The final heat treatment is carried out in the ambient atmosphere using an oven. The core is heated to about 80 to 120° C., held at the temperature for about 1 to 2 hours, further heated to about 130 to 170° C., held at the temperature for about 1½ to 3 hours, then cooled to about 100 to 60° C., and held at the temperature for about ½ to 2 hours, After the annealing treatment and optionally, resin impregnation, the dust core is covered with an insulating film for ensuring insulation to windings if necessary, provided with windings, assembled with another core, and inserted into a casing.

In the dust core, ferromagnetic metal particles have the same particle size distribution as in the starting powder.

The dust cores of the invention are suited for use as magnetic cores in transformers and inductors, cores in motors, and other electromagnetic parts. The phenolic resin-laden dust cores of the invention can also be used in choke coils in electric automobiles and air bag sensors in automobiles while their service frequency ranges from 10 to 500 kHz, preferably from 50 to 200 kHz.

EXAMPLE

Examples of the invention are given below by way of illustration and not by way of limitation. Mw is a weight average molecular weight.

Example 1

The zirconia sol and titania sol used were NZS-30A which is a $ZrO_2$ sol having a mean particle size of 62 nm and TA-15 which is a $TiO_2$ sol having a mean particle size of 5 to 50 nm, both commercially available from Nissan Chemical K.K. Dispersions were prepared from these sols by first adjusting to pH 7 and replacing water solvent by ethanol solvent.

To atomized, annealed iron powder commercially available from Heganess Co. under the trade name of ABC100.30, each dispersion was weighed and added in an amount as shown in Table 1. They were mixed for 30 minutes at room temperature by means of an automated mortar. The mixture was then dried in the ambient atmosphere at 200° C. for 30 minutes, yielding a ferromagnetic powder for compaction.

To the ferromagnetic powder was added 0.2% by weight of zinc stearate lubricant commercially available from Nitto Chemicals K.K. They were mixed for 15 minutes in a V mixer. The powder was molded under a pressure of 15 ton/cm$^2$ into a compact of toroidal shape having an outer diameter of 17.54 mm, an inner diameter of 10.195 mm, and a height of about 6 mm The compacts were then heat treated (annealed) at 600° C. for 60 minutes in a nitrogen atmosphere, yielding core samples.

For comparison purposes, core samples were prepared as above except that $ZrO_2$ powder having a mean particle size of 0.53 $\mu$m (HSY-3.0B commercially available from Dai-Ichi Rare Element Chemistry K.K.) and pneumatically comminuted $TiO_2$ powder having a mean particle size of 1 $\mu$m (commercially available from Toho Titanium K.K.) were used instead of the sol.

Each core sample was determined for magnetic flux density (B100) and coercivity (Hc) in an applied magnetic field of 100 Oe and hysteresis loss (Ph), eddy current loss (Pe) and core loss (Pc) at 1,000 mT. The losses were measured at 450 Hz and 1,000 Hz. The magnetic flux density and coercivity were measured by a direct current BH tracer Model 3257 by Yokokawa Electric K.K. The core loss was measured by a BH analyzer SY-8232 by Iwasaki Communications K.K. The results are shown in Table 1.

Similarly, core samples of toroidal shape having an outer diameter of 17.54 mm, an inner diameter of 10.195 mm, and a height of about 6 mm were prepared and measured for strength. For strength measurement, the core samples were subject to a rupture test using a desktop digital load tester (manufactured by Aoki Engineering K.K.). The inventive samples were strong enough as demonstrated by a strength of more than 16 MPa.

TABLE 1

| No. | Insulator | Amount (vol %) | Resin Class | Resin Amount (vol %) | Hc (Oe) | B 100 (kG) | Core loss Pc | Core loss Ph | Core loss Pe | Density | μ I 1 | μ I 100 |
|---|---|---|---|---|---|---|---|---|---|---|---|---|
| 1 (comparison) | $ZrO_2$ powder* | 0.25 | — | — | 2.84 | 16.40 | 3656 | 1539 | 1419 | 7.606 | 129 | 7 |
| 2 (comparison) | $ZrO_2$ powder* | 0.5 | — | — | 2.83 | 16.10 | 3274 | 1360 | 1342 | 7.603 | 137 | 8 |
| 3 (comparison) | $ZrO_2$ powder* | 1.0 | — | — | 2.81 | 15.70 | 2729 | 1009 | 1348 | 7.597 | 151 | 8 |
| 4 | $ZrO_2$ sol | 0.25 | — | — | 2.63 | 15.35 | 1026 | 402 | 611 | 7.573 | 186 | 14 |
| 5 | $ZrO_2$ sol | 0.5 | — | — | 2.38 | 13.63 | 539 | 356 | 179 | 7.444 | 119 | 25 |
| 6 | $ZrO_2$ sol | 1.0 | — | — | 2.58 | 14.08 | 590 | 375 | 212 | 7.531 | 169 | 23 |
| 7 (comparison) | $TiO_2$ powder* | 0.25 | — | — | 2.83 | 16.33 | 4084 | 1749 | 1136 | 7.609 | 79 | 7 |
| 8 (comparison) | $TiO_2$ powder* | 0.5 | — | — | 2.86 | 16.15 | 4238 | 1842 | 1114 | 7.603 | 77 | 6 |
| 9 (comparison) | $TiO_2$ powder* | 1.0 | — | — | 2.79 | 15.83 | 4008 | 1703 | 1132 | 7.587 | 80 | 7 |
| 10 (comparison) | $TiO_2$ powder* | 4.0 | — | — | 2.63 | 13.63 | 2245 | 754 | 1317 | 7.440 | 100 | 9 |
| 11 | $TiO_2$ sol | 0.25 | — | — | 2.61 | 15.30 | 588 | 360 | 224 | 7.572 | 191 | 21 |
| 12 | $TiO_2$ sol | 0.5 | — | — | 2.58 | 14.58 | 531 | 365 | 163 | 7.549 | 176 | 24 |

*outside the scope of the invention

The benefits of the invention are evident from Table 1. The core samples using the sol within the scope of the invention are significantly low in core loss as compared with the comparative core samples using titania or zirconia powder.

Example 2

Core samples were prepared as in Example 1 except that a heat resistant resin was added. As the heat resistant resin, there were furnished a silicone resin having a weight average molecular weight of 2,600, a pyrolysis temperature of about 600° C. and a heat loss of about 30% (KR153 from Shin-Etsu Chemical K.K.) and a phenolic resin having a number average molecular weight of 250, a pyrolysis temperature of about 600° C. and a heat loss of about 30% (ELS572 from Showa Polymer K.K.). The insulator and the heat resistant resin were weighed and added in amounts as shown in Table 2. The core samples were tested as in Example 1, with the results shown in Table 2.

TABLE 2

| No. | Insulator | Amount (vol %) | Resin Class | Resin Amount | Hc (Oe) | B 100 (kG) | Core loss Pc | Core loss Ph | Core loss Pe | Density | μ I 1 | μ I 100 |
|---|---|---|---|---|---|---|---|---|---|---|---|---|
| 21 | $ZrO_2$ sol | 0.25 | — | — | 2.63 | 15.35 | 1026 | 402 | 611 | 7.573 | 186 | 14 |
| 22 | $ZrO_2$ sol | 0.25 | silicone | 1.2 (0.2) | 2.50 | 15.33 | 613 | 360 | 250 | 7.559 | 190 | 19 |
| 23 | $ZrO_2$ sol | 0.25 | silicone | 2.4 (0.4) | 2.50 | 15.23 | 636 | 369 | 263 | 7.528 | 189 | 19 |
| 24 | $ZrO_2$ sol | 0.5 | — | — | 2.38 | 13.63 | 539 | 356 | 179 | 7.444 | 119 | 25 |
| 25 | $ZrO_2$ sol | 0.5 | silicone | 1.2 (0.2) | 2.54 | 14.53 | 609 | 370 | 235 | 7.524 | 134 | 19 |
| 26 | $ZrO_2$ sol | 0.5 | silicone | 2.4 (0.4) | 2.50 | 14.80 | 696 | 373 | 318 | 7.506 | 137 | 15 |
| 27 | $ZrO_2$ sol | 1.0 | — | — | 2.58 | 14.08 | 590 | 375 | 212 | 7.531 | 169 | 23 |
| 28 | $ZrO_2$ sol | 1.0 | silicone | 1.2 (0.2) | 2.50 | 13.13 | 482 | 368 | 110 | 7.455 | 114 | 33 |
| 30 | $ZrO_2$ sol | 1.0 | phenol | 1.2 (0.2) | 2.54 | 13.15 | 470 | 370 | 100 | 7.455 | 110 | 40 |

Note: Under the heading of Resin Amount, percent by weight is reported in parentheses.

Example 3

Core samples were prepared and tested as in Example 2. For comparison purpose, a core sample (No. 33) was similarly prepared, but using $SiO_2$ sol. The results are shown in Table 3.

TABLE 3

| No. | Insulator Class | Insulator Amount (vol %) | Resin Class | Resin Amount (vol %) | Core loss Pc | Core loss Ph | Core loss Pe |
|---|---|---|---|---|---|---|---|
| 31 | $ZrO_2$ sol | 0.5 | Silicone | 1.2 (0.2) | 609 | 370 | 235 |
| 32 | $TiO_2$ sol | 0.5 | Silicone | 1.2 (0.2) | 600 | 379 | 214 |
| 33 | $SiO_2$ sol* | 0.5 | Silicone | 1.2 (0.2) | 744 | 367 | 376 |

Note:
*outside the scope of the invention. Under the heading of Resin Amount, percent by weight is reported in parentheses.

It is evident from Table 3 that the inventive samples are reduced in core loss as compared with the sample using $SiO_2$ sol.

Example 4

In Example 1, an electrolytic iron powder (commercially available from Furukawa Machine Metal K.K.) was used instead of the atomized, annealed iron powder ABC100.30. Core samples were prepared as in Example 1 using the $ZrO_2$ sol (addition amount 0.5 vol %) and the $TiO_2$ sol (addition amount 0.5 vol %).

The core samples were then impregnated with a resin. The core samples were placed on a vat. A 10% ethanol solution of a phenolic resin (ELS-572) was poured into the vat until the samples were entirely immersed in the solution. The samples were kept immersed for 3 minutes. Then the samples were taken out and rested on a net support where extra resin solution was removed. The samples were placed in an oven with the ambient atmosphere, heated to 100° C., held at the temperature for 1½ hours, further heated to 150° C., held at the temperature for 2 hours, then cooled to 80° C., and held at the temperature for 1 hour. Resin-impregnated core samples were obtained in this way.

The core samples before and after resin impregnation (heat treated and impregnated, respectively) were examined by the same radial crushing strength test as in Example 1. The results are shown below.

| | Radial crushing strength | |
|---|---|---|
| | Heat treated | Impregnated |
| $ZrO_2$ sol | 16.17 MPa | 84.03 MPa |
| $TiO_2$ sol | 30.51 MPa | 86.84 MPa |

It is evident that the resin impregnation improves the rupture strength over the heat-treated samples by a factor of about 2.8 to 5. The magnetic properties such as core losses were approximately equivalent to Example 1.

Example 5

The zirconia sol used was NZS-30A (commercially available from Nissan Chemical K.K.) which is a $ZrO_2$ sol having a mean particle size of 62 nm, same as in Example 1. Dispersions were prepared from these sols by first adjusting to pH 7 and replacing water solvent by ethanol solvent.

As the heat resistant resin, two resol type phenolic resins and one novolak type phenolic resin (commercially available from Showa Polymer K.K.) were used as shown in Table 4.

height of about 6 mm. When the novolak resin was used, the powder was hot pressed at 200° C. and 8 ton/cm$^2$ because molding at room temperature was difficult.

The compacts were then annealed at 700° C. for 60 minutes in a nitrogen atmosphere, yielding core samples.

For comparison purposes, core samples were prepared as above except that a $SiO_2$ sol (NZS-30A from Nissan Chemistry K.K.) was used instead of the zirconia sol and a silicone resin having a weight average molecular weight of 2,600, a pyrolysis temperature of about 600° C. and a heat loss of about 30% (KR153 from Shin-Etsu Chemical K.K.) was used instead of the phenolic resin.

Each core sample was determined for magnetic flux density (B100) and coercivity (Hc) in an applied magnetic field of 100 Oe and hysteresis loss (Ph), eddy current loss (Pe) and core loss (Pc) at 1,000 mT. The losses and magnetic permeability ($\mu$) were measured at 1 kHz. The magnetic flux density and coercivity were measured by a direct current BH tracer Model 3257 by Yokokawa Electric K.K. The core loss was measured by a BH analyzer SY-8232 by Iwasaki Communications K.K.

Similarly, compact samples (before annealing) of toroidal shape having an outer diameter of 17.5 mm, an inner diameter of 10.2 mm, and a height of about 6 mm were prepared and measured for strength. For strength measurement, the core samples were subject to a rupture test using a desktop digital load tester (manufactured by Aoki Engineering K.K.).

The results are shown in Table 4.

TABLE 4

| Sample | Sol | | Resin | | | | B100 | Core loss (kW/m$^3$) | | | $\mu$ @ | Strength |
|---|---|---|---|---|---|---|---|---|---|---|---|---|
| | | Amount | | | | Amount | | | | | | |
| No. | Class | (vol %) | Class | Type | Mw | (vol %) | (kG) | Pc | Ph | Pe | 1 kHz | (Mpa) |
| 41 | zirconia | 0.5 | phenol (ELS-572) | resol | 250 | 2.4 | 15.8 | 1335 | 444 | 891 | 302 | 4.3 |
| 42 | zirconia | 0.5 | phenol (BRS-3801) | resol | 5500 | 2.4 | 15.8 | 600 | 440 | 160 | 330 | 2.9 |
| 43 | zirconia | 0.5 | phenol (BRP-5417) | novolak | 3000 | 2.4 | — | — | — | — | — | unmoldable |
| 44 | zirconia | 0.5 | phenol (BRP-5417) | novolak | 3000 | 2.4 | 15.3 | 650 | 470 | 180 | 295 | 0.8 |
| 45 | — | — | phenol (BRS-3801) | resol | 5500 | 3.6 | 15.8 | 2110 | 460 | 1650 | 300 | 2.9 |
| 46* | silica | 0.5 | silicone (KR-153) | — | 2600 | 2.4 | 15.7 | 1708 | 445 | 1263 | 298 | 3.1 |

*outside the scope of the invention

The zirconia sol and phenolic resin or only the phenolic resin was weighed as shown in Table 4 and added to electrolytic iron powder having a mean particle size of 110 $\mu$m (commercially available from Furukawa Machine Metal K.K.). Using a pressure kneader, these components were mixed for 30 minutes at room temperature. The mixture was dried at 200° C. for 30 minutes in the ambient atmosphere, obtaining a ferromagnetic powder for compaction.

To the ferromagnetic powder was added 0.2% by weight of zinc stearate lubricant (commercially available from Nitto Chemicals K.K.). They were mixed for 15 minutes in a V mixer. The powder was molded under a pressure of 12 ton/cm$^2$ into a compact of toroidal shape having an outer diameter of 17.5 mm, an inner diameter of 10.2 mm, and a When the powder containing the novolak type resin was molded at room temperature, the compact was too weak to handle in subsequent steps. The dust core samples within the scope of the invention were equivalent in magnetic flux density, hysteresis loss and magnetic permeability, but significantly reduced in eddy current loss and core loss. Especially when the resol type phenolic resin with Mw 5,500 or the novolak type phenolic resin with Mw 3,000 was used in combination with zirconia sol, significant drops of eddy current loss and core loss were found. When the phenolic resin was used alone, or when the silicone resin was combined with the silica sol, high temperature annealing broke the insulation between particles, resulting in increased eddy current losses.

Example 6

Core samples were prepared and tested as in Example 5 using resol type phenolic resins having different weight average molecular weights (Mw) as shown in Table 5.

The results are shown in Table 5.

TABLE 5

| Sample | Sol | | Resin | | | | B 100 | Core loss (kW/m$^3$) | | | $\mu$ @ | Strength |
|---|---|---|---|---|---|---|---|---|---|---|---|---|
| | | Amount | | | | Amount | | | | | | |
| No. | Class | (vol %) | Class | Type | Mw | (vol %) | (kG) | Pc | Ph | Pe | 1 kHz | (Mpa) |
| 51 | zirconia | 0.5 | phenol (BRS-3801) | resol | 5500 | 2.4 | 15.8 | 600 | 440 | 160 | 330 | 2.9 |
| 52 | zirconia | 0.5 | phenol (ELS-577) | resol | 1200 | 2.4 | 15.9 | 609 | 421 | 188 | 334 | 4.1 |
| 53 | zirconia | 0.5 | phenol (ELS-579) | resol | 1800 | 2.4 | 15.9 | 584 | 414 | 170 | 330 | 3.8 |
| 54 | zirconia | 0.5 | phenol (ELS-580) | resol | 1600 | 2.4 | 15.9 | 569 | 413 | 156 | 328 | 3.3 |
| 55 | zirconia | 0.5 | phenol (ELS-582) | resol | 1500 | 2.4 | 15.8 | 568 | 419 | 149 | 319 | 3.2 |
| 56 | zirconia | 0.5 | phenol (ELS-583) | resol | 570 | 2.4 | 15.8 | 595 | 434 | 161 | 320 | 3.9 |
| 41 | zirconia | 0.5 | phenol (ELS-572) | resol | 250 | 2.4 | 15.8 | 1335 | 444 | 891 | 302 | 4.3 |

As compared with phenolic resins with Mw less than 300, phenolic resins with Mw more than 300 lead to significantly reduced eddy current losses and core losses.

TABLE 6

| Sample | Sol | | Resin | | | | Annealing | B 100 | Core loss (kW/m$^3$) | | | $\mu$ @ |
|---|---|---|---|---|---|---|---|---|---|---|---|---|
| | | Amount | | | | Amount | temp. | | | | | |
| No. | Class | (vol %) | Class | Type | Mw | (vol %) | (° C.) | (kG) | Pc | Ph | Pe | 50 kHz |
| 61 | zirconia | 2.0 | phenol (ELS-582) | resol | 1500 | 8.75 | 600 | 5.9 | 440 | 295 | 145 | 84 |
| 62 | zirconia | 2.0 | phenol (ELS-582) | resol | 1500 | 8.75 | 650 | 5.9 | 375 | 230 | 145 | 88 |
| 63 | zirconia | 2.0 | phenol (ELS-582) | resol | 1500 | 8.75 | 700 | 6.0 | 315 | 165 | 150 | 90 |
| 64 | — | — | phenol (ELS-582) | resol | 1500 | 13.13 | 600 | 5.1 | 584 | 300 | 284 | 35 |
| 65 | — | — | phenol (ELS-582) | resol | 1500 | 13.13 | 650 | 5.1 | 545 | 255 | 290 | 38 |
| 66 | — | — | phenol (ELS-582) | resol | 1500 | 13.13 | 700 | 5.3 | 601 | 235 | 366 | 40 |
| 67* | — | — | silicone (KR-153) | — | 2600 | 13.13 | 600 | 5.8 | 2140 | 490 | 1650 | 80 |
| 68* | — | — | silicone (KR-153) | — | 2600 | 13.13 | 650 | 5.8 | 4534 | 1281 | 3253 | 81 |
| 69* | — | — | silicone (KR-153) | — | 2600 | 13.13 | 700 | 5.9 | 6165 | 1204 | 4757 | 84 |
| 70* | zirconia | 2.0 | silicone (KR-153) | — | 2600 | 8.75 | 600 | 6.0 | 1338 | 349 | 989 | 89 |
| 71* | zirconia | 2.0 | silicone (KR-153) | — | 2600 | 8.75 | 650 | 6.1 | 1666 | 320 | 1346 | 93 |
| 72* | zirconia | 2.0 | silicone (KR-153) | — | 2600 | 8.75 | 700 | 6.1 | 2283 | 302 | 1981 | 96 |

*comparison

Example 7

Core samples were prepared as in Example 5 except that a supermalloy having a mean particle size of 60 $\mu$m (molybdenum permalloy commercially available from Heganess Co.) was used instead of the electrolytic iron powder and the annealing temperature was changed as shown in Table 6. They were tested as in Example 5. The losses were measured at 50 kHz and 100 mT and the magnetic permeability was measured at 50 kHz.

The results are shown in Table 6.

Even when the ferromagnetic metal powder was replaced by an alloy powder, the dust cores according to the invention are significantly reduced in eddy current loss and core loss. The benefits of the invention become more outstanding as the annealing temperature becomes higher.

Example 8

Core samples were prepared and tested as in Example 5 except that a titania sol was used instead of the zirconia sol. The titania sol used herein was TA-15 (Nissan Chemical K.K.) which is a $TiO_2$ sol having a mean particle size of 5 to 50 nm, same as in Example 1. A dispersion was prepared from the sol by first adjusting to pH 7 and replacing water solvent by ethanol solvent.

Like the dust cores using the zirconia sol, the dust cores using the titania sol were significantly reduced in core loss.

There has been described a ferromagnetic powder composition comprising a ferromagnetic metal powder, titania sol and/or zirconia sol and optionally, a heat resistant resin. The composition is pressure molded into dust cores which exhibit a high magnetic flux density, low coercivity, low loss and high mechanical strength. The dust cores can be annealed at high temperatures while maintaining the improved properties.

Japanese Patent Application Nos. 96731/1997 and 368032/1997 are incorporated herein by reference.

While the invention has been described in what is presently considered to be a preferred embodiment, other variations and modifications will become apparent to those skilled in the art. It is intended, therefore, that the invention not be limited to the illustrative embodiments, but be interpreted within the full spirit and scope of the appended claims.

We claim:

1. A ferromagnetic powder composition for dust cores comprising, a ferromagnetic metal powder and 0.1 to 15% by volume based on said ferromagnetic metal powder of a titania sol and/or a zirconia sol;

wherein said ferromagnetic metal powder is of iron.

2. A ferromagnetic powder composition for dust cores comprising, a ferromagnetic metal powder and 0.1 to 15% by volume based on said ferromagnetic metal powder of a titania sol and/or a zirconia sol; and further comprising 0.1 to 30% by volume, based on said ferromagnetic metal powder, of a heat resistant resin.

3. The ferromagnetic powder composition of claim 1 or 2 wherein said titania and/or zirconia sol has a mean particle size of 0.01 to 0.1 $\mu$m.

4. The ferromagnetic powder composition of claim 2 wherein said heat resistant resin is a silicone resin.

5. The ferromagnetic powder composition of claim 4 wherein the silicon resin has a weight average molecular weight of 700 to 3,300.

6. The ferromagnetic powder composition of claim 2 wherein said heat resistant resin is selected from the group consisting of an epoxy resin, phenoxy resin, polyamide resin, polyimide resin and polyphenylene sulfide resin.

7. The ferromagnetic powder composition of claim 2 wherein said heat resistant resin is a phenolic resin.

8. The ferromagnetic powder composition of claim 7 wherein said phenolic resin is a resol type phenolic resin.

9. The ferromagnetic powder composition of claim 7 wherein the phenolic resin has a weight average molecular weight of 300 to 7,000.

10. A dust core which has been prepared by pressure molding a ferromagnetic powder composition according to any one of claim 3 or 4.

11. The dust core of claim 1 or 2 which has been further heat treated and then impregnated with a resin.

12. A method for preparing a dust core comprising the steps of:

pressure molding a ferromagnetic powder composition according to claims 4, or 6 into a compact, and heat treating the compact at a temperature of 400 to 700° C.

13. A method for preparing a dust core comprising the steps of:

pressure molding a ferromagnetic powder composition according to claim 1 into a compact, and heat treating the compact at a temperature of 500 to 850° C.

* * * * *

UNITED STATES PATENT AND TRADEMARK OFFICE

CERTIFICATE OF CORRECTION

PATENT NO. : 6,102,980
DATED : August 15, 2000
INVENTOR(S) : Masami Endo et al.

It is certified that error appears in the above-identified patent and that said Letters Patent is hereby corrected as shown below:

Column 18,
Line 22, "claim 3 or 4" should read -- claim 1 or 2 --;
Line 29, "4, or 6" should read -- 4 or 6 --;
Line 35, "claim 1" should read -- claim 7 --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*